US005146999A

United States Patent [19]

Wiser et al.

[11] Patent Number: 5,146,999

[45] Date of Patent: Sep. 15, 1992

[54] SHOE ASSEMBLY WITH CATCHER FOR CORING

[75] Inventors: Helma S. Wiser, Bountiful; Steven R. Radford, South Jordan, both of Utah

[73] Assignee: Baker Hughes Incorporated, Houston, Tex.

[21] Appl. No.: 680,304

[22] Filed: Apr. 4, 1991

[51] Int. Cl.[5] ..... E21B 25/14

[52] U.S. Cl. ..... 175/254; 294/86.11

[58] Field of Search ..... 175/254, 249, 246, 244, 175/242, 240, 58; 166/99; 294/86.11

[56] References Cited

U.S. PATENT DOCUMENTS

| | | | |
|---|---|---|---|
| 2,083,062 | 6/1937 | Hampton | 294/86.11 X |
| 2,140,417 | 12/1938 | Conklin | 175/254 X |
| 2,539,435 | 1/1951 | Kirby, II | 294/86.11 X |
| 2,645,290 | 7/1953 | Fortenberry | 175/254 X |
| 2,692,160 | 10/1954 | Miller et al. | 294/86.11 X |
| 3,067,821 | 12/1962 | Crooks | 294/86.11 X |
| 3,952,817 | 4/1976 | Anderson | 175/240 |
| 4,059,155 | 11/1977 | Greer | 175/254 X |
| 4,552,229 | 11/1985 | Radford et al. | 175/240 |
| 4,605,075 | 8/1986 | Radford et al. | 175/58 |
| 4,606,416 | 8/1986 | Knighton et al. | 175/58 |
| 4,607,710 | 8/1986 | Radford | 175/249 |
| 4,651,835 | 3/1987 | Davis | 175/58 |

FOREIGN PATENT DOCUMENTS

| | | | |
|---|---|---|---|
| 638706 | 12/1978 | U.S.S.R. | 175/254 |

*Primary Examiner*—Hoang C. Dang

*Attorney, Agent, or Firm*—Trask, Britt & Rossa

[57] ABSTRACT

The application is directed to a shoe assembly with a core catcher for retaining a core of an unconsolidated rock or earth formation in a coring barrel. The shoe assembly includes a tube section adapted to fit removably within the core barrel near the coring bit. Two sets of hinged fingers are attached to the inner surface of the tube section on respective circumferential lines which are displaced from each other. The fingers are movable about the hinged ends between an open position in which the fingers do not significantly occlude the passageway, and a closed position in which the fingers do occlude the passageway. The fingers are biased toward the closed position by means of respective springs associated with each finger. When in the closed position, the two sets of fingers together occlude at least 90% of the cross-section of the passageway. The fingers are urged to the open position by the action of a core moving through the coring barrel away from the drilling end. When the motion of the core into the barrel stops and then reverses as the core barrel is withdrawn from the wellbore, the springs exert sufficient force to move the fingers into the core taken from an unconsolidated formation. Continued upward movement of the core barrel drives the fingers through the core material to the closed position. In the closed position, the core catcher holds the core in place in the core barrel during its removal from the drill hole.

14 Claims, 2 Drawing Sheets

SHOE ASSEMBLY WITH CATCHER FOR CORING

BACKGROUND OF THE INVENTION

1. Field

The invention relates generally to drilling equipment for subterranean boreholes and more specifically to coring tools for obtaining core samples.

2. State of the Art

Coring comprises the drilling and removal of core samples of rock from a drilled borehole. This technique has long been used in the oil and gas drilling industry to obtain information about the rock being drilled. Good cores can provide data for production estimates, reserve calculations, and regarding the expected behavior of different subsurface formations during the drilling and producing periods. Especially, the porosity of the reservoir rock and its connate water saturation can be determined with high accuracy from core samples.

The procedure in coring is typically as follows. A coring bit cuts a cylindrical core, which slides into a non-rotating inner core barrel or tube. The core barrel is seated within an outer drill barrel which is attached to and rotates with the coring bit. The inner core barrel or tube includes a "catcher" for catching and retaining the core within the core barrel while the core barrel is being pulled from the drill hole.

To provide the most accurate and useful information, it is important that the core as removed from the core barrel be intact and that it accurately reflect the layers of rock from which it is drawn. The catcher plays an important role in maintaining the core in its virgin condition as it is drawn from the hole.

Most such catchers are designed for use in so-called consolidated formations, which are relatively solid, self-supporting, and generally hard. A core from such a formation will not fall apart easily and so a catcher need not cover the entire lower opening of the core barrel. In fact, a catcher can simply be a frictional fitting forming a narrowed portion of the core barrel through which the core cannot quite slide back and out of the core barrel.

However, when pulling cores from unconsolidated formations such as sandstone, catchers of this type are unsuitable. The core may crumble, pieces may be lost through the lower opening of the core barrel, and upper regions of the core may shift due to the loss of pieces. Thus, a catcher for use in unconsolidated formations must provide substantially complete closure of the cross-section of the core barrel. Also, in unconsolidated formations less force is required to break the core from the formation with which it is integral.

One type of core catcher designed for use in unconsolidated formations has a set of cooperating flapper valves which provide a relatively complete closure of the cross-section of the core barrel. However, the lips of the flappers can impede passage of the core into the barrel and cause jamming. Jamming of the core requires termination of the coring procedure.

Another type of core catcher, described in U.S. Pat. Nos. 4,605,075 and 4,606,416, includes an inner shroud or sleeve which conceals the flapper valves from the core until coring is terminated. When coring is complete, the sleeve is displaced to free the flappers to catch the core. Unfortunately, such devices are relatively complex and may occasionally fail, leading to partial or complete core loss. U.S. Pat. No. 4,607,710 describes a core catcher without an inner sleeve wherein the flapper valves are biased toward an open position and a collet release mechanism permits cams to drive the valves closed. This device is also relatively complicated and expensive to make.

Still another approach to a core catcher for unconsolidated formations employs a positive displacement mechanism which may be hydraulically or otherwise externally activated to extend the dogs into the core barrel (for exâmple U.S. Pat. Nos. 4,651,835 and 4,552,229). This mechanism is also very complicated and expensive.

Because of their complexity, as mentioned above, the scavenging mechanisms are subject to failure, which can result in loss or disturbance of the core.

Accordingly, a need remains for a simple, inexpensive and reliable device to retain a core of an unconsolidated formation within the core barrel during its removal from the drill hole.

SUMMARY OF THE INVENTION

A shoe assembly with a core catcher for retaining a core of an unconsolidated rock or earth formation in a core barrel has been invented. The shoe assembly includes a tube section adapted to removably attach to the inner tube assembly for placement within the outer core barrel at its lower end near the coring bit. The tube section is open at both ends to form a passageway through which a core can extend. Two sets of hinged finger members are attached to the inner surface of the tube section on respective circumferential lines which are longitudinally displaced from each other. The fingers are movable about the hinged ends between an open position in which the fingers do not significantly occlude the passageway, and a closed position in which the fingers do occlude the passageway.

The finger members are biased toward the closed position by means of respective springs associated with each finger. When in the closed position, the two sets of finger members together occlude at least 90% of the cross-section of the passageway. The fingers are urged to the open position by the action of a core moving through the coring barrel away from the drilling end. When the motion of the core into the barrel stops, and then reverses during retrieval of the care from the wellbore, the springs exert sufficient force to move the fingers into the core taken from an unconsolidated formation, and continued upward movement of the core barrel forces the fingers through the core to the closed position. In the closed position, the core catcher holds the core above the catcher in place in the core barrel during its removal from the drill hole.

DETAILED DESCRIPTION OF THE ILLUSTRATED EMBODIMENT

Figure 1:
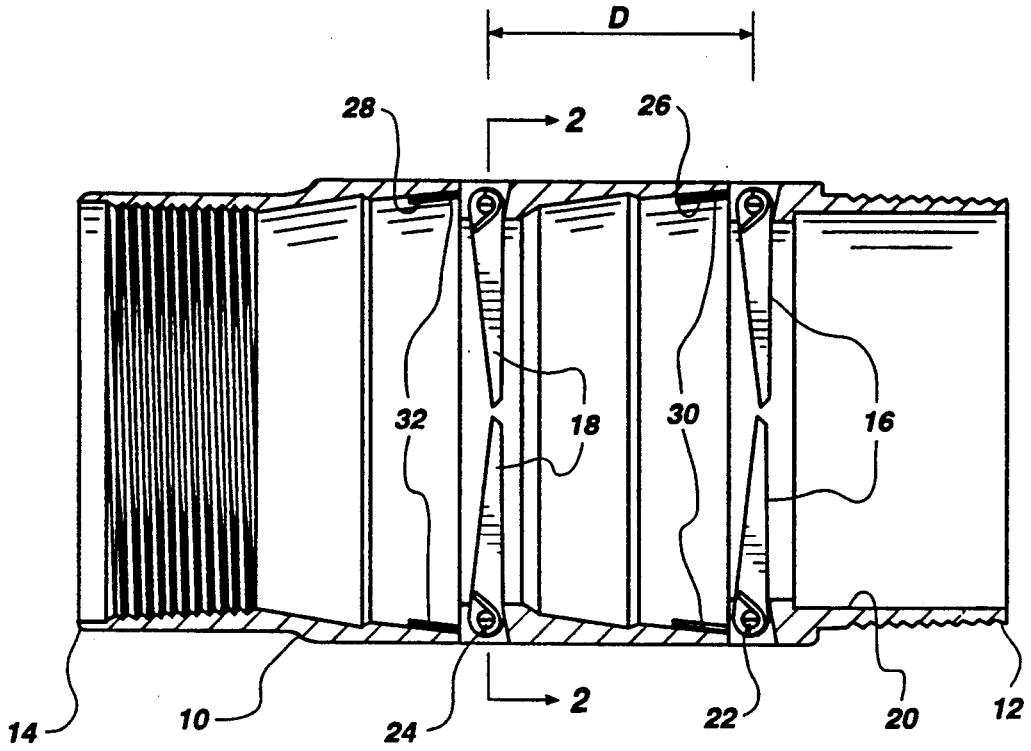
FIG. 1 is a plan view of the core catcher.

A shoe assembly includes tube section 10 having an externally threaded lower end 12 and an internally threaded upper end 14 (FIG. 1). Tube section 10 is configured to be removably installed within a drilling barrel as part of an inner core barrel assembly with lower end 12 being the end closest to the coring bit.

Ends 12, 14 are open so that tube section 10 defines a passageway for a core sample which enters via lower end 12.

A plurality of first finger members 16 and a plurality of second finger members 18 extend from inner surface 20 of tube section 10. While not depicted in FIG. 1, it should be understood that rings of finger members 16 and 18 are disposed about the inner surface 20 of the tube section. Finger members 16, 18 are attached to tube section 10 via a plurality of respective pins 22, 24 which constitute hinged attachment means. Desirably, finger members 16, 18 are of a length similar to, but not longer than, the inner radius of tube 10. Pins 22 fit into cooperating bores located at attachment points along a first inner circumference of tube 10, while pins 24 are similarly attached along a second inner circumference displaced by a distance D from the first inner circumference. Preferably, D is at least greater than the length of fingers 16, 18.

Figure 2:
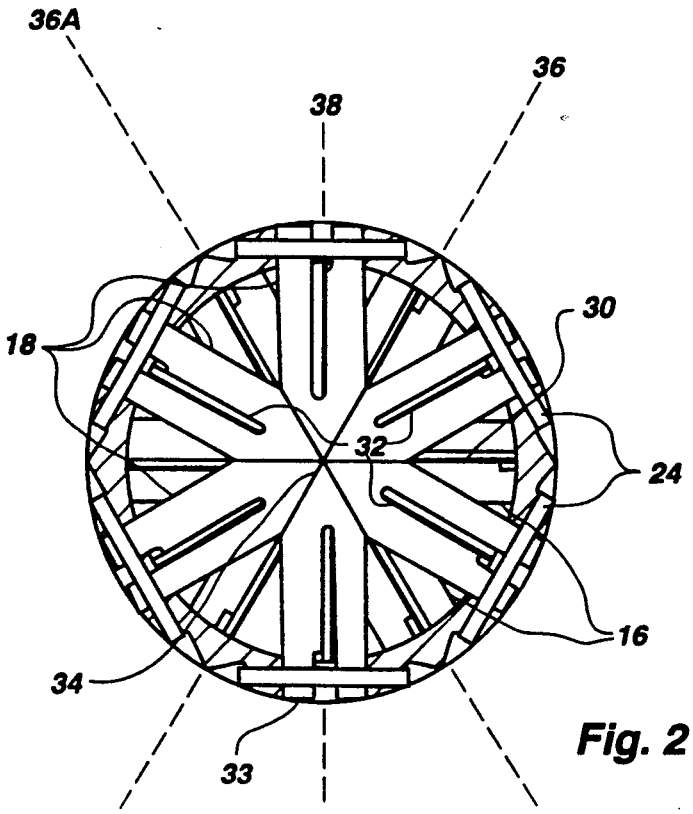
FIG. 2 is a cross-section of the core catcher taken along section line 2—2 of FIG. 1.

Finger members 16, 18 are movable about their respective pins 22, 24 between a closed position and an open position. In the closed position, finger members 16, 18 extend more or less perpendicular to the longitudinal axis of tube 10 into the passageway and partially occlude it (FIG. 1). As best seen in FIG. 2, in the closed position first and second finger members 16, 18 together occlude greater than 90% of the cross-sectional area of the passageway. In a preferred embodiment, finger members 16, 18 in the closed position occlude 97% of the area of the passageway. In the open position, finger members 16, 18 extend more or less parallel to the longitudinal axis of tube 10 toward upper end 14. Finger members 16, 18 in the open position do not significantly occlude the passageway. Desirably, inner surface 20 is configured with annular recesses 26, 28 into which finger members 16 and 18 respectively can fit so that they do not obstruct passage of the core into the core barrel.

FIG. 2 illustrates an arrangement of first and second finger members which provides 97% occlusion. Six first finger members 16 and six second finger members 18 are disposed in pairs so that members of a pair are attached to opposite sides of inner surface 20. Each finger is attached at a point circumferentially displaced approximately 60° from its neighbors. Additionally, the attachment points of first fingers 16 are circumferentially displaced about 30° from the attachment points of second fingers 18. While the illustrated embodiment provides the desired occlusion of the passageway, other arrangements and numbers of finger members 16, 18 are within contemplation. For example, three levels or layers of finger members might be employed, more or less than six finger members per level might be utilized, and the shapes of the finger members could also be altered, within the ambit of the invention.

In the illustrated embodiment, finger members 16, 18 are disposed in pairs with the two members of each pair attached opposite each other (FIG. 1). As best seen in FIG. 2, each of finger members 18 is substantially rectangular at the attached end 33 with the corners of free end 34 truncated along respective diametrical lines 36, 36A which are circumferentially displaced 30° from the centerline 38 of the finger. Each finger thus tapers to a point at free end 34. The angled edges of free end 34 subtend an angle of 60°. In the closed position, the respective points of all six finger members 18 approximately meet at the center of cylindrical tube section 10. Finger members 16 are similarly configured and arranged.

Helical torsion springs 30, 32 are associated respectively with first and second finger members 16, 18. Springs 30, 32 constitute bias means for biasing finger members 16, 18 to the illustrated closed position. Together, fingers 16, 18 and their associated springs 30, 32 form the core catcher portion of the shoe assembly. Springs 30, 32 must exert sufficient tension to urge finger members 16, 18 through unconsolidated formations to the closed position, yet be relaxed enough that movement of the core into the barrel can push finger members 16, 18 aside and into recesses 26, 28, effectively without damaging the core.

Figure 3:
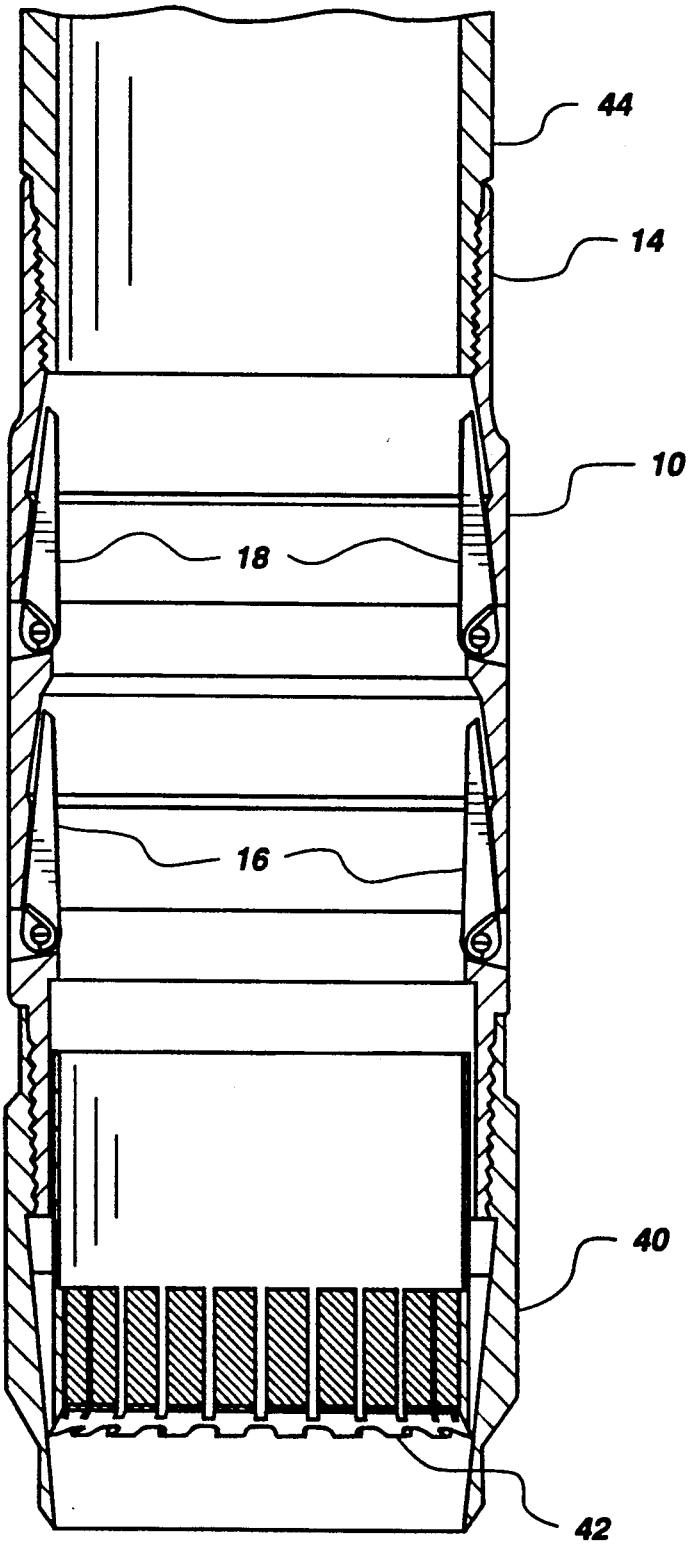
FIG. 3 is a plan view of the core catcher in association with the lower end of an inner core barrel.

FIG. 3 illustrates the core catcher of FIG. 1 in association with the lower end of a typical inner core barrel assembly. Finger members 16, 18 are shown in the open position which they would assume when a core is being pushed into the core barrel. Lower end 12 of the core catcher is threadedly attached to an inner shoe 40. Optionally and preferably, a typical catcher for consolidated formations 42 is also disposed within shoe 40. Upper end 14 of the core catcher of the present invention is threadedly attached to an inner core barrel 44.

During the coring operation, a coring bit associated with the lower end of the drill barrel cuts a core. The core is pushed into the inner core barrel through tube section 10 of the shoe assembly by the downward movement of the coring bit as it cuts. The movement of the core through tube section 10 urges finger members 16, 18 upward and against inner surface 20 of the tube section.

When the coring operation is complete, drilling is stopped and the core ceases to be pushed into the core barrel. The tension exerted by springs 30, 32 then urges finger members 16, 18 into the unconsolidated material of the core and withdrawal of the core barrel from the wellbore results in the further penetration of the core by finger members 16, 18 until their closed position is reached. The two sets of finger members 16, 18 hold the core within the coring barrel as it is pulled from the drill hole.

What is claimed is:

1. In a coring apparatus of the kind having a coring barrel and a coring bit for removing a core of a rock formation, a core retaining device comprising:

a tube section having first and second ends and an inner surface defining a cylindrical passageway for receiving a core, said tube section adapted to fit removably within a core barrel with said first end proximal to a coring bit;

a plurality of first finger members each having hinge means at one end for attachment to aid inner surface, said first finger members being attached at first attachment points lying on a first inner circumference of said tube section with the respective hinge ends of each said first finger member being circumferentially displaced at substantially equal angular intervals from adjacent said first finger members; and a plurality of second finger members each having hinge means at one end for attachment to aid inner surface, said second finger members being attached by said hinge means at second attachment points lying on a second inner circumference of said tube section with each said second finger member being circumferentially displaced at substantially equal angular intervals from adjacent said second finger members; wherein each of said first and second finger members is movable at said hinge means between an open position wherein said finger members do not occlude said passageway and a closed position wherein said finger members partially occlude said passageway; and said first attachment points of said first finger members are circumferentially displaced from said second attachment points of said second finger members to provide that in said closed position, said first finger members occlude a substantially different portion of the cross-sectional area of said tube opening than said second finger members.

2. The core retaining device of claim 1 wherein said first and second finger members together occlude greater than about 95% of said tube opening.

3. The core retaining device of claim 1, wherein said first and second finger members are each of a length substantially equal to the inner radius of said tube section.

4. The core retaining device of claim 1, wherein said inner surface of said tube section is provided with recesses configured to receive said first and second finger members in said open position.

5. The core retaining device of claim 1, wherein said tube section has attachment means associated with said first and second ends for removably affixing said tube section to adjacent segments of an inner core barrel.

6. A shoe assembly with a core catcher for use in a coring apparatus of the kind having a coring barrel and a coring it associated with one end of the coring barrel, comprising:

a tube section having first and second ends and an inner surface defining a cylindrical passageway for receiving a core, said tube section adapted to fit removably within a core barrel with said first end proximal to a coring bit;

a plurality of first and second finger members, each said finger member having a free end and a hinge end and each said finger member further including hinge means associated with said hinge end for hingedly attaching said finger member to said tube section and for permitting movement of said free end between an open position wherein said free end is positioned adjacent said inner surface of said tube section, and a closed position wherein said free end extends away from said inner surface into said passageway, and bias means operably associated with each said hinge end for biasing said finger member to said closed position; wherein said first finger members are attached to said tube section at attachment points lying on a first inner circumference of said tube section and said second finger members are attached to said tube section at attachment points lying on a second inner circumference of said tube section, said first and second inner circumferences being displaced longitudinally from one another by a distance equal to or greater than the length of said finger members, said attachment point of each said first finger member being circumferentially displaced from the attachment points of adjacent said first finger members, and said attachment point of each said second finger member being circumferentially displaced from the attachment point of adjacent said second finger members; and said attachment point of each individual said second finger member being further circumferentially displaced from said attachment points of each of said first finger members.

7. The shoe assembly of claim 6, wherein in said closed position said first and second finger members together occlude at least 90% of the cross-sectional area of said passageway.

8. The shoe assembly of claim 6, wherein said bias means is a spring.

9. The shoe assembly of claim 6 wherein said finger members are urged to said open position by a core received in said passageway.

10. A shoe assembly with a core catcher for use in a coring apparatus of the kind having a coring barrel and a coring bit associated with one end of the coring barrel, comprising:

a tube section having upper and lower ends and an inner surface defining a cylindrical passageway for receiving a core, said tube section adapted to fit removably within a core barrel with said lower end proximal to a coring bit;

a plurality of first finger members each having a free end and a hinge end hingedly attached to said tube section at points spaced at approximately equal intervals along a first inner circumference, each said first finger member being movable between an open position in which said first finger member extends adjacent said inner surface and a closed position in which said first finger member extends away from said inner surface to partially block said tube section, said hinge ends spaced such that angled gaps occur between adjacent said first finger members;

a plurality of substantially identical second finger members each having a free end and a hinge end hingedly attached to said tube section at points spaced at approximately equal intervals along a second inner circumference which is longitudinally displaced from said first inner circumference, said second finger members being movable in like manner to said first finger members between an open position and a closed position, said second finger members being arranged to at least partially occlude said gaps between adjacent said first finger members; and bias means operably associated with each said hinge end for biasing said finger members to said closed position.

11. The shoe assembly of claim 10 wherein said first finger members have a length which is substantially the same for all said first finger members.

12. The shoe assembly of claim 11 wherein said length is approximately equal to the inner radius of said tube section.

13. The shoe assembly of claim 11 wherein said second finger members are substantially equal in length to said length of said first finger members.

14. The shoe assembly of claim 13 wherein in said closed position, said first and second finger members together occlude at least about 95% of the cross-sectional area of said passageway.

* * * * *